US005999762A

United States Patent [19]

Shoji

[11] Patent Number: 5,999,762

[45] Date of Patent: Dec. 7, 1999

[54] IMAGE FORMING APPARATUS AND METHOD THEREFOR

[75] Inventor: Hisashi Shoji, Kanagawa-ken, Japan

[73] Assignee: Ricoh Company, Ltd., Tokyo, Japan

[21] Appl. No.: 09/109,865

[22] Filed: Jul. 6, 1998

[30] Foreign Application Priority Data

Jul. 4, 1997 [JP] Japan ..... 9-180130

[51] Int. Cl.[6] ..... G03G 15/06

[52] U.S. Cl. ..... 399/55; 399/53; 399/270

[58] Field of Search ..... 399/53, 55, 222, 399/252, 265, 267, 270, 279, 285

[56] References Cited

U.S. PATENT DOCUMENTS

| | | | |
|---|---|---|---|
| 4,653,427 | 3/1987 | Hosaka et al. | 399/270 |
| 4,662,311 | 5/1987 | Shoji et al. | 399/270 |
| 5,469,245 | 11/1995 | Aoshima et al. | 399/270 |
| 5,469,246 | 11/1995 | Sunaga et al. | 399/270 |
| 5,565,966 | 10/1996 | Ochiai et al. | 399/270 X |
| 5,574,545 | 11/1996 | Hosoi et al. | 399/270 |
| 5,655,191 | 8/1997 | Furuya et al. | 399/270 X |

FOREIGN PATENT DOCUMENTS 5-210301 8/1993 Japan .

*Primary Examiner*—Sandra Brase

*Attorney, Agent, or Firm*—Oblon, Spivak, McClelland, Maier & Neustadt, P.C.

[57] ABSTRACT

An image forming apparatus including, an image bearing member capable of having a latent image formed thereon, and a developer bearing member that bears a developer comprising a toner and a carrier, wherein a latent image formed on the image bearing member is developed by a non-contacting method under application of a vibrating electric field, so that the toner is transferred from the developer bearing member toward the image bearing member, and wherein the following relation holds:

$$1.0\times10^{-4}<t_1^2/L_T<1.0\times10^{-3}(\mathrm{sec}^2/\mathrm{m}),$$

where $t_1$ represents a phase period during which a toner particle of the toner is transferred from the toner bearing member to the latent image during application of the vibrating electric field and $L_T$ represents a weight average particle diameter of the toner particles.

14 Claims, 4 Drawing Sheets

IMAGE FORMING APPARATUS AND METHOD THEREFOR

BACKGROUND OF THE INVENTION

1. Field of the Invention

The present invention relates to an image forming apparatus such as a copying machine, a printer, or a facsimile machine.

2. Discussion of the Background

A two-component developing method is well known as a remarkable developing method especially for high-speed image reproduction using powder type toner, such as electrophotography or the like. In recent years, the two-component developing method is used as a major technology in the copying machine, laser printer, etc.

In the two-component developing method, a developer is conveyed to a surface of a non-magnetizable sleeve in which magnets are mounted inside thereof, which is a developer bearing member, and the developer kept in a brush-like state (magnet-brush) contacts or is positioned adjacent to an image bearing member. Developing is implemented with a toner, which is mixed with the developer, which selectively adheres onto a latent image of an image bearing member by an electric field between the image bearing member on which a latent image is formed and the sleeve to which an electric bias is applied.

However, in a field that requires a high quality image, it is considered to be a problem that image noise, such as background fouling and/or deterioration of a sharpness of an image, due to irregular toner adherence onto the latent image, tends to appear. An image having a uniformity of dots that is formed in an interval of dozens of microns is required in order to smoothly reproduce a halftone image, for example, a printer, a digital copying machine, or the like. However, when the dot image is observed under a microscope, a large dispersion of shapes of dots or area of dots is found and toner is irregularly adhered between the dots. If this phenomenon is significant, roughness cannot be disregarded and thereby the image is less uniform.

To solve the above-described problem, a method for applying a developing bias (hereinafter called AC bias) having a vibration-component is proposed in Japanese Laid-Open Patent Publication No. 6-19213/1994, Japanese Laid-Open Patent Publication No. 7-72699/1995, Japanese Laid-Open Patent Publication No. 7-114223/1995, and the like.

However, in the conventional developing method described in each of above Publications, the quality of the image is not always improved but also deteriorates depending on a condition of applying the developing bias. This has been experimentally confirmed by the inventor. It is assumed that the movement of the toner or the carrier is affected by various factors.

Conditions such as a range of diameters of toner particles and diameters of carrier particles and a range of frequencies of the vibration bias are described in the Japanese Laid-Open Patent Publication No. 7-114223/1995, which indicates that a high frequency is preferably not less than 6000 Hz, and that the volume resistivity of the carrier is preferably not greater than $10^{10}$ Ω cm to maintain a good developing efficiency.

However, in accordance with an additional test carried out by the present inventor, it is confirmed that a phenomenon of blurring of a trailing edge portion of a solid image (hereinafter called trailing edge blurring) tends to occur in the range of the aforementioned frequency. Further, it is confirmed that, when the frequency of the vibration bias is raised up indefinitely, the effect of applying an AC bias is lost. Even though a slight improvement is confirmed by using a low resistivity carrier, a sufficient image quality is not obtained.

Various types of carriers are known, including a carrier composed of a magnetizable particle coated with resin, which is widely used in order to obtain durability (disclosed in, for example, Japanese Laid-Open Patent Publication No. 6-19213/1994). Further, a non-contacting developing method in which a magnetizable resin coated carrier is used and an AC bias (vibration bias) applied is described in Japanese Laid-Open Patent Publication No. 7-72699/1995.

However, in accordance with an additional test performed by the present inventors problems of image quality exist such that the uLiilo-rnity of the dot area is not sufficient and a phenomenon such as the trailing edge blurring is observed. The following phenomenon is surmised to be the reason that causes the problems.

If the carrier has a high electric resistance, for example, a positive-polarity charge (the opposite polarity to that of the toner) remains on a surface of the carrier when the toner has left from the carrier. On the contrary, if the carrier has a low electric resistance, the positive-polarity charge remaining on the surface of the carrier flows away in a relatively short time period. Thus, when the carrier has a high electric resistance, the charge of the opposite polarity to the toner remains on the surface of the carrier when the toner has left from the carrier. Therefore, the charge remaining on the surface of the carrier is surmised to generate a noise that abnormally attracts the toner appropriately moving towards the latent image on a photoconductive element.

There are some methods for making the magnetizable resin-coated carrier to have a low electric resistance. One of the methods that decreases the electric resistance of the carrier uses a thin coat layer and has a problem in regard to prolonging the life of the developer. As another method, a material having a low electric resistance may be used as a coat layer itself. Practically, a carrier composed of a ferrite or a magnetite as a core material, and silicone resin or the like as a coat layer in which carbon or the like is scattered can be used, since such a carrier is inexpensive and stable.

However, when the present inventor carried out developing by using the aforementioned carrier, i.e., a carrier composed of a ferrite or a magnetite core, and silicone resin or the like as a coat layer, in which carbon is scattered applying AC bias, a phenomenon that the toner image has small white flecks (hereinafter called white flecks) where the toner is removed is observed.

After repeated experiments, the inventor found that if peak-to-peak voltage of the AC bias is decreased, the less white flecks occur, and only at the toncr-adhered part of the image (the part where the potential difference from the peak potential of the AC bias is relatively large), and not when the carrier having the layer in which the carbon is not scattered is used, and the like. Consequently, it is surmised that the phenomenon of white flecks is caused by a discharge from the carbon adjacent to the surface of the carrier to the image bearing member.

SUMMARY OF THE INVENTION

In view of the above-mentioned considerations it is an object of the present invention to provide an image forming apparatus that produces an image of a good uniformity of dots without occurrence of background fouling and deterioration of sharpness even when a durable resin coated carrier in which a coated layer having low electric resistance is used.

Another object of the present invention is to provide the image forming apparatus that can obtain good images without white flecks even when a developing bias including a vibration component is applied.

Briefly, these and other objects of the present invention as hereinafter will become more readily apparent can be attained by an image forming apparatus that includes an image bearing, member capable of having a latent image formed thereon, and a developer bearing member that bears a developer comprising a toner and a carrier, wherein a latent image formed on the image bearing member is developed by a non-contacting method under application of a vibrating electric field, so that the toner is transferred from the developer bearing member toward the image bearing member, and wherein the following relation holds:

$$1.0\times10^{-4}<t_1^2/L_T<1.0\times10^{-3}\ \text{sec}^2/\text{m},$$

where $t_1$ represents a phase period during which a toner particle of the toner is transferred from the toner bearing member to the latent image during application of the vibrating electric field and $L_T$ represents a weight average particle diameter of the toner particles.

As another aspect of the present invention, in the image forming apparatus mentioned above the following relation holds:

$$t_2^2/L_C<0.005\ \text{sec}^2/\text{m}$$

where $t_2$ represents a period of the vibrating electric field and $L_C$ represents a weight average particle diameter of the carrier particle.

As yet another aspect of the present invention, in the image forming apparatus mentioned above the relation holds in which an absolute value of a potential difference between a surface voltage of the image bearing member and a peak voltage of the developer bearing member is equal to or less than $5.0\times10^8$ d volts, where d represents a closest distance between the image bearing member and the developer that is born on said developer bearing member.

BRIEF DESCRIPTION OF THE DRAWINGS

A more complete appreciation of the invention and the attendant advantages thereof will be readily obtained by referring to the following detailed description when considered in connection with the accompanying drawings, wherein.

DESCRIPTION OF THE PREFERRED EMBODIMENT

Before explaining a detailed example of the present invention further description of the experiments performed by the invention will be hereinafter explained.

The present inventor has found that white flecks can be prevented even though an AC bias is applied in a case of a developing method in which an image bearing member and a developer on a developer bearing member do not contact each other in a developing area (an area where a toner between the image bearing member and the developer bearing member can be transferred), as a result of repeated of studies based on various problems in the conventional image forming apparatus. Further, the inventor has also found that an image quality is improved under a limited condition of the AC bias.

Figure 3:
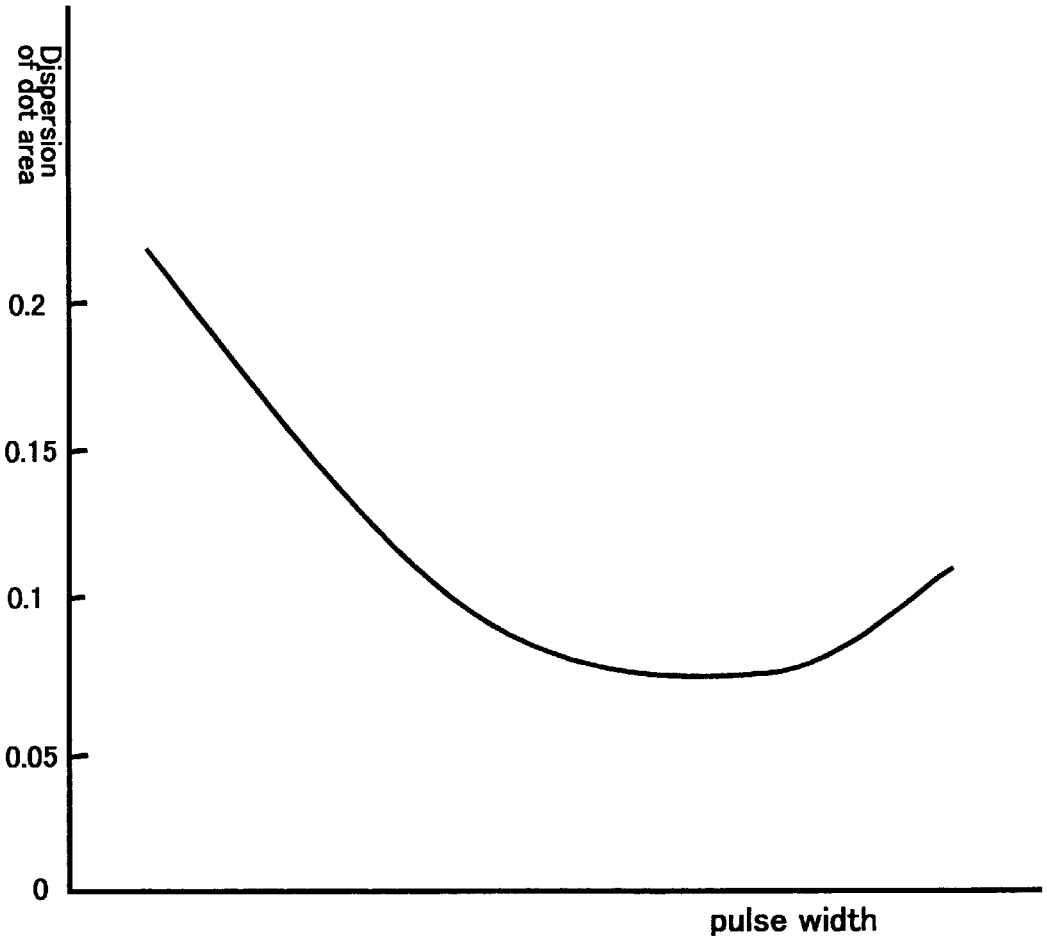
FIG. 3 is a graph showing a relationship between a pulse width of a square wave of a developing bias and dispersion of a dot area.

In an experiment which the present inventor carried out, when a dispersion of a dot area is measured upon forming images in which a transferring time of the toner in a direction to an image bearing member is varied (i.e., a width of a square wave pulse that functions to transfer the toner in a direction to the image bearing member is varied), data are obtained, in which the dispersion of the dot area decreases at the pulse width of a particular range (since the period is constant, this means the duty cycle in a particular range), and a uniformity of the dots is improved. The data are shown in a graph in FIG. 3. In this graph, the axis of abscissas indicates the pulse of the square wave bias, and the axis of ordinates indicates the dispersion of the dot area (a standard deviation divided by an average value). As shown in FIG. 3, the dispersion of the dot area is decreased in a range of the predetermined pulse width.

Further, the estimated value of the dispersion of the dot area is determined, by measuring a plurality of dot areas with an image analyzing device and dividing the standard deviation by an average area. It is apparent that when this value is 0.15 or less, the uniformity of the dots is good, and more particularly, when the value is 0.1 or less, better uniformity of the dots can be obtained.

On the other hand, according to an estimation by setting up a simple model, it is apparent that, when a charged particle is placed in a vibrating electric field, the particle starts reciprocating motion and the amplitude of the motion is in inverse proportion to a square of the frequency of the vibrating electric field and a diameter of the toner particle. Namely, when f represents the frequency of the vibrating electric field, $E_0$ represents the amplitude of the electric field, and $L_T$ represents the diameter of the toner particle, the amplitude A of the reciprocating motion of the toner is given by the following formula: (k is a constant)

$$A=k\cdot E_0/(f^2\cdot)L_T.$$

As a result, the present inventor hypothesized that there might be a relationship between a moving time of the toner to the image bearing member at high speed and the diameter of the toner particle, and carried out an experiment to confirm this point.

Figure 4:
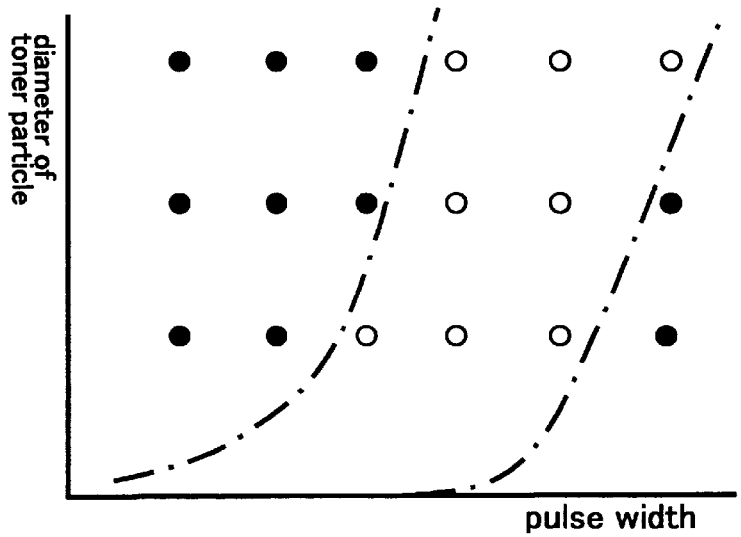
FIG. 4 is a graph showing a distribution of reproducing quality of a dot in a case of varying a particle diameter of a toner and a level of a duty cycle of the square wave bias.

In this experiment, the inventor formed images varying the level of a diameter of the toner particle and the duty cycle of the square wave bias, and estimated the resultant value. Consequently, it is apparent that when the value in which the square of time during which the toner receives the force towards the image bearing member (i.e., the square of the width of the pulse) is divided by the diameter of the toner particle, is determined within a particular range, the reproducing ability of the dot is significantly improved. The experimental data are shown in the graph in FIG. 4. In this graph, the axis of abscissas indicates the pulse width of the square wave bias, and the axis of ordinates indicates the diameter of the toner particle. For each toner particle diameter, a mark ○ (white circle) indicates a good uniformity of the dots, and a mark ● (black circle) indicates a bad uniformity of the dots. As shown in the graph, the condition of good uniformity of the dots is distributed in an area nipped between two parabolas.

Further, a carrier used in this experiment is made of a magnetite core coated with silicone resin. The volume resistivity is controlled to about $10^{10}$ Ω cm.

In accordance with the result of the above-described experiment, it is concluded that the image qualities are improved by forming an electric field so that the following equation (1) is satisfied.

$$1.0\times10^{-4}<t_1^2/L_T<1.0\times10^{-3}\ \text{sec}^2/\text{m} \quad (1)$$

where $t_1$ represents a phase period during which toner particles are transferred from the toner bearing member to a latent image part on the image bearing member while a vibrating electric field (an AC bias) is applied. and $L_T$ represents a weight average particle diameter of the toner particles.

Further, the movement of the carrier has also studied. In accordance with the previous study, it has been estimated that the image quality deteriorates due to adhering of the carrier to the image bearing member and being separated from a magnet-brush on a carrier bearing member (developing sleeve) when the carrier carries out a violent motion.

Accordingly, if the carrier is considered to be a charged particle as well as the toner, a motion of the carrier can be estimated to be in inverse proportion to the square of a frequency of a vibrating electric field and a diameter of the carrier particle. As a result of an estimation of image quality upon forming images while varying the diameter of the carrier particle and the frequency of the vibrating electric field, it is apparent that the adhering of the carrier to the face of the image disappeared when the value obtained from dividing the square of the period of the vibrating electric field by the diameter of the carrier particle stays in a specific range. Namely, the image quality is improved by forming the electric field according to the following equation:

$$t_2^2/L_C<0.005\ \text{sec}^2/\text{m} \quad (2).$$

where $t_2$ represents a period of the vibrating electric field and $L_C$ represents a weight average particle diameter of the carrier particle.

Accordingly, if a condition is determined so that the aforementioned equations (1) and (2) are satisfied, the state in which the toner easily moves and the carrier scarcely moves can be realized. Consequently, not only a reproducing ability of the halftone is improved but also background fouling and trailing edge blurring can be significantly decreased.

Thus, by using a carrier having a coat layer around which a carbon is scattered, in a non-contact state at the developing area, a partial discharging (a discharge from the carbon adjacent to a surface of the carrier to the image bearing member) can be prevented. Further, the problem of an occurrence of the white flecks can also be prevented, the size of the vibrating electric field in the developing area is enlarged and the movement of the toner can be activated. Accordingly, the toner can adhere to the latent image with improved high fidelity. Further, since an electric resistivity is low, the charge on the surface of the carrier tends to be uniform. Therefore, as an effect, since an attracting force of static electricity that acts on the toner once left from the carrier is difficult to increase, the end portion blurring or the like image noise is prevented from occurring.

A detailed example of the present invention will now be described.

Figure 1:
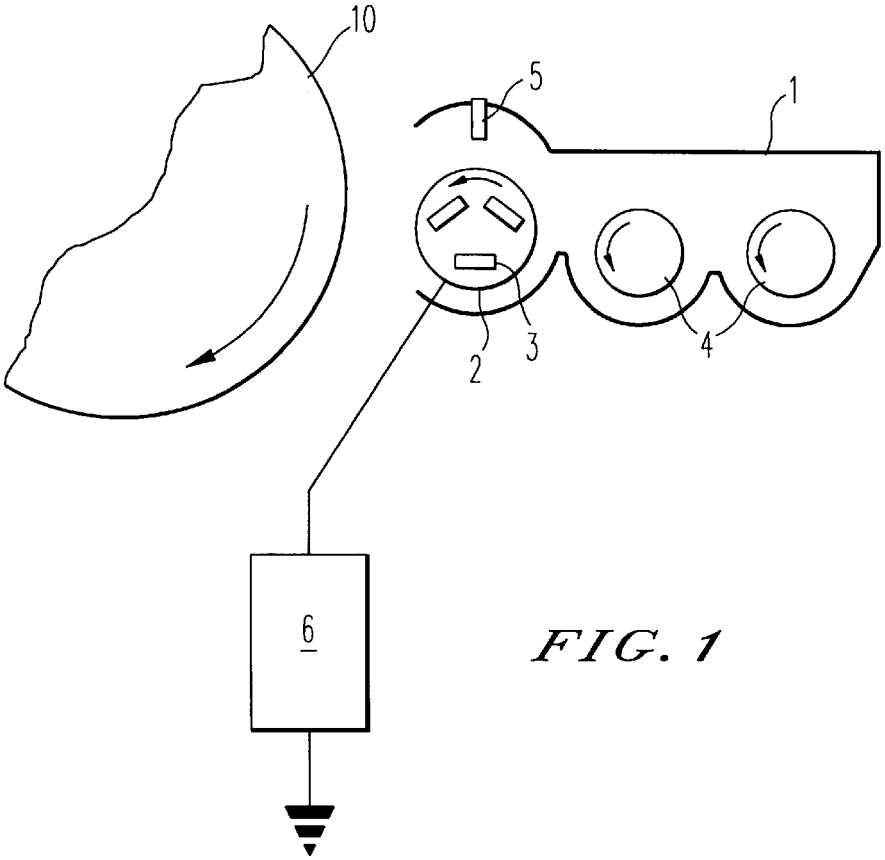
FIG. 1 is a schematic diagram showing the vicinity of a developing device of an image forming apparatus in a first example of the present invention.

FIG. 1 shows a construction in the vicinity of a developing device in an example of the present invention. A developing device 1 shown in this figure is constructed with a developing sleeve (carrier bearing member) 2, an agitating member 4, a doctor blade 5, or the like. The developing sleeve 2 is constructed with a non-magnetic conductive material, a surface of which is finished with appropriate asperity by sand blast or the like treating. The developing sleeve 2 rotates counterclockwise as shown by the arrow, and a plurality of fixed magnets are disposed inside the magnetic sleeve 2. A developing bias (AC bias), which is described later, is applied to the developing sleeve 2 from a bias power source 6. Further, in a developer container in the developing device 1, there are disposed two agitating members 4 that oppositely move the developer. Further, at an upper part of the developing sleeve 2, a doctor blade 5 for limiting a conveying amount of the developer to a developing area is disposed.

The developer that is agitated and conveyed by two agitating members 4 is drawn up to the developing sleeve 2 by an action of the internal magnet 3 when reached adjacent to the developing sleeve 2. Further, a convection current of the developer occurs upstream of the doctor blade 5 (upstream of the rotating direction of the sleeve 2, the right side of the blade 5 in the figure), and the toner and the carrier are mixed. Accordingly, the toner is sufficiently and uniformly charged.

The amount of the developer that is conveyed to the developing area becomes constant by a gap between the doctor blade 5 and the developing sleeve 2. In the developing area, a magnet-brush (a brush-like shaped toner and carrier) that is formed by the action of the internal magnet 3 is positioned close to, but not in contact with, a photoconductive element drum 10, and the toner is transferred to the latent image by the electric field formed between a bias voltage of the developing sleeve 2 and the latent image on the photoconductive element drum (image bearing member) 10.

Figure 2:
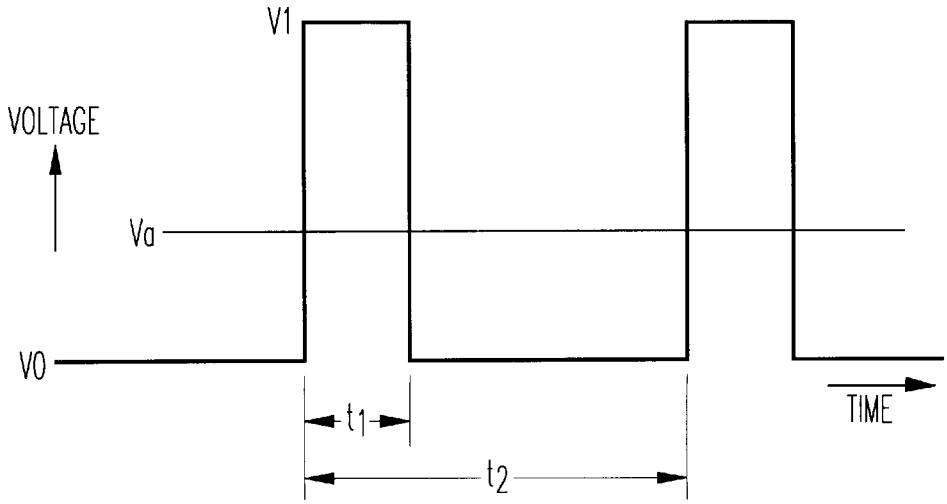
FIG. 2 is a waveform chart showing a waveform of a developing bias applied to a developing sleeve of the developing device in FIG. 1.

FIG. 2 is a waveform chart showing a waveform of a developing bias (AC bias) that is applied from the bias power source 6 to the developing sleeve 2. The axis of abscissas of the waveform chart indicates time, and the axis of ordinates indicates a voltage value where an upward of the chart represents a direction in which the toner receives a force to the photoconductive element drum 10. In FIG. 2, $V_1$ represents a voltage value when the toner receives a maximum force to the photoconductive element drum, $V_0$ represents a voltage value when the toner receives a maximum force to the sleeve 2. $T_1$ represents a time period in which $V_1$ continues (a pulse width of $V_1$), and $t_2$ represents a period of a vibrating bias. Further, an integral average Va of the voltage value is set about −500 V to −700 V as similar to a usual DC bias. However, the relation is $Va=V_0+(V_1-V_0)\times t1/t2$.

As a first example of the present invention, a carrier a weight average particle diameter of 50 μm composed of a magnetite core coated with silicone resin, which is controlled in a volume resistivity of $10^{10}$ Ω cm, is used. The toner having a weight average particle diameter of 7.5 μm is used. Further, the carrier and the toners are mixed as a developer having a toner density of 5 wt (weight) % (a mass ratio of the toner to the developer). Furthermore, a latent image of a potential of the background, −700 V, and that of the image part, −100 V is formed on the photoconductive element drum.

When a thickness of the developer layer on the developing sleeve 2 of the present invention was measured, the maximum thickness was about 500 μm. The developing gap (the gap between the developing sleeve 2 and the photoconductive element drum 10) is set to 600 μm. Accordingly, a distance between the photoconductive element drum 10 and the tip end portion of the developer kept on the developing sleeve 2 (closest distance) d: 100 μm.

In this case, as a developing bias, integral average Va is −600 V, a vibration component is set to the frequency 5 kHz, at the peak to peak voltage of 1.5 kV, the duty cycle is varied so that the above formulas (1) and (2) are satisfied, and an image of good dot uniformity was obtained in a range of the duty cycle of the vibrating bias ($t_1/t_2$), 15% to 40%.

When the duty cycle is out of the preferable range mentioned above (15 to 40%) and is, for example, 10%, a developed image has an insufficient amount of toner, resulting in decrease of the image density, and further the dispersion of the area of the dot images becomes greater. Furthermore, when the duty cycle is above the preferable range mentioned above and is, for example, 45%, the developed image has an excessive amount of toner, resulting in adhering of the toner to the background in the vicinity of an edge part of the image, and the problems which occur as described below. An increase of the image density in the halftone occurs because the size of the dot becomes greater. A reproducing ability of the gradation becomes unbalanced, and the uniformity of the area of the dot images is deteriorated. On the contrary, when the duty cycle stays in a range of 20% to 30%, a good dot uniformity can be observed. As evident in FIG. 3, when this value is 0.15 or less, the uniformity of the dots is good, and more particularly, when the value is 0.1 or less, better uniformity of the dots can be obtained.

According to the preferred condition as mentioned above, $t_1^2/L_T$ is in a range of $1.2\times10^{-4}$ sec²/m to $8.5\times10^{-4}$ sec²/m, and $t_2^2/L_C$ is in a range of $8.0\times10^{-4}$ sec²/m. Further, the peak electric field value that occurs between the tip end portion of the developer on the developing sleeve 2 and the photoconductive element drum 10 is $1.4\times10^7$ V/m to $1.8\times10^7$ V/m.

Further, since, when the duty cycle is 15%, the minimum potential (a surface potential of the image part) of the photoconductive element drum 10 is −100 V, and the peak voltage (a potential that the absolute value thereof is the highest) of the developing sleeve 2 is −1875 V, the peak voltage between the tip end portion of the developer on the developing sleeve 2 and the photoconductive element drum 10 is about $-1.8\times10^7$ V/m. Similarly, when the duty cycle is 40%, the peak value of the electric field between the tip end portion of the developer on the developing sleeve 2 and the photoconductive element drum 10 is about $-1.4\times10^7$ V/m. Furthermore, when the duty cycle is 15% and the peak voltage is −2000 V, the peak electric field value between the tip end portion of the developer on the developing sleeve 2 and the photoconductive element 10 is about $-2.2\times10^7$ V/m. In any of the conditions as mentioned above, the white flecks did not occur.

Hereupon, when the tip portion of the magnet-brush is moved closer to the photoconductive element drum 10 by adjusting the position of the doctor blade 5, even though an abnormal image is not found until the gap between the tip end portion of the magnet-brush and the photoconductive element drum 10 becomes to 5 μm, however, when the gap is set 4 μm, the white flecks suddenly increased.

Further, as a second example of the present invention, in a case of fixing the duty cycle of the developing bias to 20%, using the same developer as the one used in the aforementioned first example, an image with good dot uniformity was able to be obtained in the range of 2.5 kHz to 7 kHz in the frequency of the developing bias.

When the frequency of the developing bias is out of preferable range mentioned above and is, for example, 2.3 kHz, a developed image has an excessive amount of toner, resulting in adhering of the toner to the background in the vicinity of an edge part of the image, and problems occur as described below. An increase of the image density in the halftone occurs because the size of the dot becomes greater. A reproducing ability of the gradation becomes unbalanced, and the uniformity of the area of the dot images is deteriorated. Further, if the frequency of the developing bias exceeds, for example, 7.4 kHz, the amount of the developing toner decreases, a sufficient image density cannot be obtained, and the dispersion of the dot area is enlarged.

According to the preferred condition as mentioned above, $t_1^2/L_T$ is in a range of $1.1\times10^{-4}$ sec²/m to $8.5\times10^{-4}$ sec²/m, and $t_2^2/L_C$ is in a range of $4.1\times10^{-4}$ sec²/m to $3.2\times10^{-3}$ sec²/m. Further, the peak electric field value that occurs between the tip end portion of the developer on the developing sleeve 2 and the photoconductive element drum 10 is $1.7\times10^7$ V/m.

Further, as a third example of the present invention, in a case of fixing the duty cycle to 10% using the same carrier as that used in the aforementioned each example, a good image can be obtained with a frequency of the developing bias in a range of 2 kHz to 3.5 kHz. In addition, when the frequency becomes 2 kHz or less, an adhering of the carrier to the image is significantly increased.

When the frequency of the developing bias exceeds the aforementioned preferable range, namely, if the frequency is set to 3.7 kHz, the image is developed with insufficient amount of the toner and sufficient image density cannot be obtained and the dispersion of the areas of dots is increased. On the contrary, the present inventor discovered that when the frequency of the developing bias is in a range of 3.2 kHz to 3.5 kHz, an effect especially for preventing adhering of the carrier can be obtained.

According to the preferred condition as mentioned above, $t_1^2/L_T$ is in a range of $1.1\times10^{-4}$ sec²/m to $3.3\times10^{-4}$ sec²/m, and $t_2^2/L_C$ is in a range of $1.6\times10^{-3}$ sec²/m to $5.0\times10^{-3}$ sec²/m. Further, the peak electric field value that occurs between the tip end portion of the developer on the developing sleeve 2 and the photoconductive element drum 10 is $1.85\times10^7$ V/m.

Furthermore, as a fourth example of the present invention, in a case of using the toner having a particle diameter of 5 μm (using the carrier having the same diameter to the one used in each above-mentioned example), if the frequency is fixed to 5 kHz, an image of a good dot uniformity was able to be obtained in the range of the duty cycle of 15 to 30%.

When the duty cycle is out of the preferred range above mentioned and is, for example, 11%, a developed image has an insufficient amount of toner, resulting in decrease of the image density, and further greater dispersion of the area of the dot images. On the contrary, if the duty cycle exceeds the above-mentioned proper range, and is set to, for example, 36%, the image is developed with the excessive amount of the toner. Accordingly, problems such as adhering of the toner to the background adjacent to the edge part of the image, increasing of the toner density value at the halftone by the enlarged dots, breaking up of the balance of the gradation, and the deterioration of the uniformity of the dots area occur.

According to the preferred condition as mentioned above, $t_1^2/L_T$ is in a range of $1.8\times10^{-4}$ sec$^2$/m to $7.2\times10^{-4}$ sec$^2$/m, and $t_2^2/L_C$ is in a range of $8.0\times10^{-4}$ sec$^2$/m. Further, the peak electric field value that occurs between the tip end portion of the developer on the developing sleeve 2 and the photoconductive element drum 10 is $1.6\times10^7$ V/m to $1.8\times10^7$ V/m.

Furthermore, as a fifth example of the present invention, in a case of fixing the duty cycle using the same developer as that used in the fourth example, an image of good uniformity of the dots can be obtained under the condition that the frequency of the developing bias is in a range of 3 to 8.5 kHz.

When the frequency of the developing bias is out of preferred range mentioned above and is, for example, 2.8 kHz, a developed image has an excessive amount of toner, resulting in adhering of the toner to the background in the vicinity of an edge part of the image, and problems occur as described below. An increase of the image density in the halftone occurs because the size of the dot becomes greater. A reproducing ability of the gradation becomes unbalanced, and the uniformity of the area of the dot images is deteriorated. Further, if the frequency of the developing bias is lowered to, for example, 9 kHz, the amount of the developing toner decreases, a sufficient image density cannot be obtained, and the dispersion of the dot area is enlarged. When the frequency of the developing bias is set to 4 to 6 kHz, a good uniformity of the dots is observed.

According to the preferred condition as mentioned above, $t_1^2/L_T$ is in a range of $1.1\times10^{-4}$ sec$^2$/m to $8.9\times10^{-4}$ sec$^2$/m, and $t_1^2/L_C$ is in a range of $2.8\times10^{-4}$ to $2.2\times10^{-3}$ sec$^2$/m. Further, the peak electric field value that occurs between the tip end portion of the developer on the developing sleeve 2 and the photoconductive element drum 10 is $1.7\times10^7$ V/m.

Further, as a sixth example of the present invention, when the developing is carried out varying the minimum gap (closest distance:d) between the developer layer on the developing sleeve 2 and the photoconductive clement drum 10 by adjusting the distance between the doctor blade 5 and the developing sleeve 2 under the same condition as that of the aforementioned first example, the present inventor discovered that the white flecks do not appear at the gap of 5 $\mu$m, but do appear at a gap equal to or less than 5 $\mu$m.

When the minimum gap is 5 $\mu$m, the peak electric field value that occurs between the tip end portion of the developer on the developing sleeve 2 and the photoconductive element drum 10 is $3.6\times10^8$ V/m. However, under this condition, some white flecks rarely occur due to an occurrence of partially strong electric field. The white flecks can completely be prevented by expanding the gap between the developer layer and the photoconductive element drum so that the peak voltage of the above-mentioned electric field becomes $5.0\times10^7$ V/m.

According to the aforementioned experiments, the occurrence of white flecks can be prevented when the absolute value of the potential difference between the surface potential of the photoconductive element drum 10 and the peak potential of the developing sleeve 2 is not greater than $(5.0\times10^8)$d Volts, when d (meters) represents the closest distance between the photoconductive element drum 10 and the tip end portion of the developer supported on the developing sleeve.

Further, as a seventh example, in the case of using a toner having a particle diameter of 9 $\mu$m instead of using the toner noted in the aforementioned first example (with the same conditions as the first example other than the toner), a good image having uniform dots can be obtained in a range of duty cycle of 15% to 45% upon fixing the frequency of developing bias at 5 kHz.

When the duty cycle is out of preferable range mentioned above and is, for example, 14%, a developed image has an insufficient amount of toner, resulting in decrease of the image density, and further the dispersion of the area of the dot images becomes greater. Furthermore, when the duty cycle is greater than the preferable range mentioned above and is, for example, 48, the developed image has an excessive amount of toner, resulting in adhering of the toner to the background in the vicinity of an edge part of the image, and problems occur as described below. An increase of the image density in the halftone occurs because the size of the dot becomes greater. A reproducing ability of the gradation becomes unbalanced, and the uniformity of the area of the dot images is deteriorated.

According to the preferred condition as mentioned above, $t_1^2/L_T$ is in a range of $1.0\times10^{-4}$ sec$^2$/m to $9.0\times10^{-4}$ sec$^2$/m, and $t_2^2/L_C$ is in a range of $8.0\times10^{-4}$ sec$^2$/m. Further, peak electric field value that occurs between the tip end portion of the developer on the developing sleeve 2 and the photoconductive element drum 10 is $1.3\times10^7$ V/m to $1.8\times10^7$ V/m.

Further, as an eighth example of the present invention, when a carrier having the diameter of 40 $\mu$m instead of that used that in the aforementioned first example, and when the duty cycle and the peak voltage are fixed at 15%, and 2 kV respectively, an image having a good uniformity of the dots is obtained in the frequency range of 2.3 to 5 kHz (with the same conditions as the first example, except for frequency). Furthermore, the thickness of the developer layer is 400 $\mu$m and the closest distance between the photoconductive element drum 10 and the developer d is 200 $\mu$m.

When the frequency of developing bias is below the preferred range mentioned above and is, for example, 2.2 kHz, adhering of the carrier to the image significantly increases. Further, when the frequency exceeds the aforementioned preferred range and is for example, 5.5 kHz, a developed image has an insufficient amount of toner, resulting in decrease of the image density, and greater dispersion of the area of the dot images.

According to the preferable condition as mentioned above, $t_1^2/L_T$ is in a range of $1.2\times10^{-4}$ sec$^2$/m to $5.7\times10^{-4}$ sec$^2$/m, and $t_2^2/L_C$ is in a range of $1.0\times10^{-3}$ sec$^2$/m to $4.7\times10^{-3}$ sec$^2$/m. Further, the peak electric field value that occurs between the tip end portion of the developer on the developing sleeve 2 and the photoconductive element drum 10 is $1.1\times10^7$ V/m.

Further, as a ninth example of the present invention, when a carrier having the diameter of 70 $\mu$m instead of that used in the aforementioned first example, and when the duty cycle and the peak voltage are fixed at 15%, and 1 kV respectively, an image having a good uniformity of the dots is obtained in the frequency range of 1.7 to 3.5 kHz (with the same conditions as the first example, except for frequency). Furthermore, the thickness of the developer layer is 550 $\mu$m and the closest distance between the photoconductive element drum 10 and the developer d is 50 $\mu$m.

When the frequency of developing bias is below the preferred range mentioned above and is, for example, 1.6 kHz, an adhering of the carrier to the image,e significantly increases. Further, when the frequency exceeds the aforementioned preferred range and is for example, 5.5 kHz, a developed image has an insufficient amount of toner, resulting in decrease of the image density, and the dispersion of the area of the dot images becomes greater.

According to the preferred condition as mentioned above, $t_1^2/L_T$ is in a range of $1.1\times10^{-4}$ sec$^2$/m to $4.6\times10^{-4}$ sec$^2$/m, and $t_2^2/L_C$ is in a range of $1.2\times10^{-3}$ sec$^2$/m to $4.9\times10^{-3}$ sec$^2$/m. Further, the peak electric field value that occurs between the tip end portion of the developer on the developing sleeve 2 and the photoconductive element drum 10 is $2.8\times10^7$ V/m.

Figure 5:
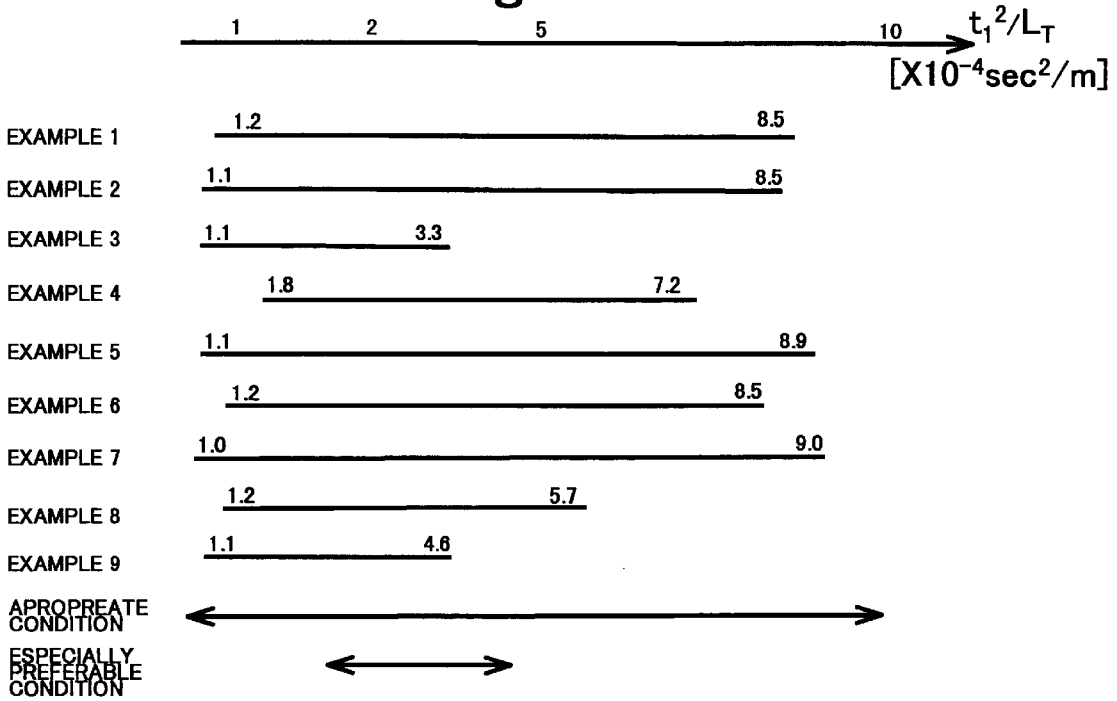
FIG. 5 is a graph showing an appropriate range in a relationship between a time for transferring the toner to an image bearing member and a weight average particle diameter of the toner in each of the examples of the present invention.

FIG. 5 shows the preferred range of "$t_1^2/L_T$" As shown in this figure, the preferred range of "$t_1^2/L_T$" for obtaining a good uniformity of dots is 1.0 to $10.0\times10^4$ sec$^2$/m, and each of the aforementioned examples indicates values ranges within this range. Further, when "$t_1^2/L_T$" is in a range of 2.0 to $5.0\times10^4$ sec$^2$/m, the present inventor discovered that excellent uniformity of dots can be obtained.

Figure 6:
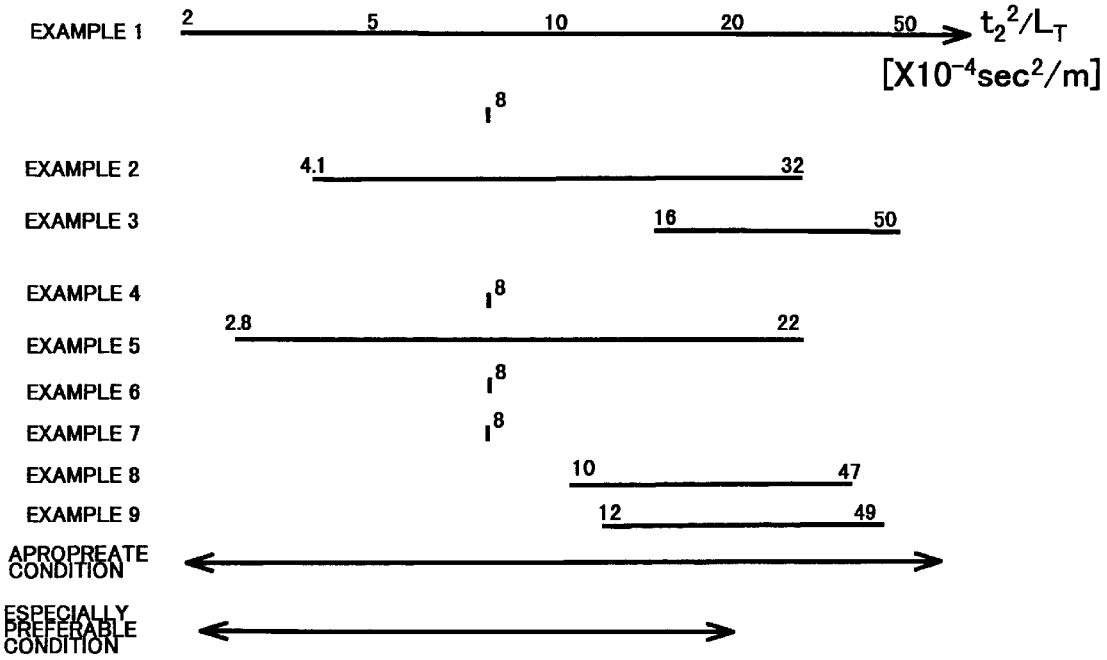
FIG. 6 is a graph showing an appropriate range in a relationship between a period of the developing bias and the weight average particle diameter in each of the examples of the present invention.

FIG. 6 shows the preferred range of "$t_1^2/L_C$". As shown in this figure, the preferred range of "$t_1^2/L_C$" for avoiding the carrier adhering is $50\times10^4$ sec$^2$/m or less, and each of the aforementioned examples values within this range.

Figure 7:
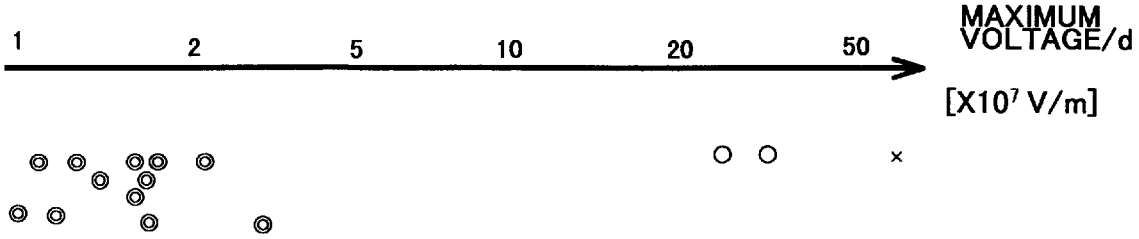
FIG. 7 is a graph showing an appropriate range of an absolute value of an electric field that is generated between a tip end portion of a developer on the developing sleeve and a photoconductive element in each of the examples of the present invention.

In FIG. 7, a preferred range of an absolute value of the electric field that occurs between the tip end portion of the developer on the developing sleeve and the photoconductive element drum in each of the examples is shown. In the present invention, this preferred range is equal to or less than $5.0\times10^8$ d V/m, and white flecks occur above this range. In the figure, a mark X indicates a condition when white flecks occur, a mark ○ indicates a good condition, and a mark ◎ indicates a better condition effective for preventing occurrence of white flecks. The value of each aforementioned is indicated by the mark ◎ in the figure (a plurality of conditions in the same example is indicated in FIG. 7).

Having now fully described the invention, it will be apparent to one of ordinary skill in the art that many changes and modifications can be made thereto without departing from the spirit and scope of the invention as set forth herein. For example, the image forming apparatus shown in FIG. 1 uses a negative-positive developing method (as described in the first example, the developing method is a reverse development in which the toner is adhered to the latent image part whose potential is decayed by irradiation of light, where the potential of the background on the photoconductive element drum is −700 V, and the potential of the image part is −100 V), however the present invention is applicable for an image forming apparatus using a positive-positive developing method.

This application is based on Japanese Patent Application No. 09-180130, filed on Jul. 4, 1997, and No. 10-1333639 filed on May 15, 1998, respectively, the entire contents of which are herein incorporated by reference.

What is claimed as new and desired to be secured by Letters Patent of the United State is:

1. An image forming apparatus comprising:

an image bearing member capable of having a latent image formed thereon; and a developer bearing member that bears a developer comprising a toner and a carrier, wherein a latent image formed on said image bearing member is developed by a non-contacting method under application of a vibrating electric field, so that the toner is transferred from said developer bearing member toward said image bearing member, and wherein the following relation holds:

$$1.0\times10^{-4}<t_1^2/L_T<1.0\times10^{-3}\ (\text{sec}^2/\text{m}),$$

where $t_1$ represents a phase period during which a toner particle of the toner is transferred from the toner bearing member to the latent image during application of the vibrating electric field and $L_T$ represents a weight average particle diameter of the toner particles.

2. An image forming apparatus according to claim 1, wherein the following relation further holds:

$$t_2^2/L_C<0.005\ \text{sec}^2/\text{m},$$

where $t_2$ represents a period of the vibrating electric field and $L_C$ represents a weight average particle diameter of the carrier particle.

3. An image forming apparatus according to claim 2, wherein an absolute value of a potential difference between a surface voltage of said image bearing member and a peak voltage of said developer bearing member is equal to or less than $(5.\times10^8)$d volts, where d represents a closest distance in meters between said image bearing member and developer that is born on said developer bearing member.

4. An image forming apparatus according to claim 1, wherein an absolute value of a potential difference between a surface voltage of said image bearing member and a peak voltage of said developer bearing member is equal to or less than $(5.\times10^8)$d volts, where d represents a closest distance in meters between said image bearing member and developer that is born on said developer bearing member.

5. The image forming apparatus according to claim 1 wherein the carrier comprises conductive particles.

6. The image forming apparatus according to claim 5, wherein the conductive particles comprise particulate carbon.

7. An image forming apparatus comprising:

a developer bearing member that bears a developer comprising a toner and a carrier, wherein a latent image formed on an image bearing member is developed by a non-contacting method under application of a vibrating electric field, so that the toner is transferred from said developer bearing member toward said image bearing member, and wherein the following relation holds:

$$t_1^2/L_C<0.005\ (\text{sec}^2/\text{m}),$$

where $t_2$ represents a period of the vibrating electric field and $L_C$ represents a weight average particle diameter of the carrier particle.

8. An image forming apparatus according to claim 7, wherein an absolute value of a potential difference between a surface voltage of said image bearing member and a peak voltage of said developer bearing member is equal to or less than $(5.\times10^8)$d volts, where d represents a closest distance in meters between said image bearing member and developer that is born on said developer bearing member.

9. The image forming apparatus according to claim 7, wherein the carrier comprises conductive particles.

10. The image forming apparatus according to claim 9, wherein the conductive particles comprise particulate carbon.

11. An image forming apparatus comprising:

an image bearing member capable of having a latent image formed thereon; and a developer bearing member that bears a developer comprising a toner and a carrier, wherein a latent image formed on said image bearing member is developed by a non-contacting method under application of a vibrating electric field, so that the toner is transferred from said developer bearing member toward said image bearing member, and wherein an absolute value of a potential difference between a surface voltage of said image bearing member and a peak voltage of said developer bearing member is equal to or less than $(5\times10^{8})d$ volts, where d represents a closest distance in meters between said image bearing member and developer that is born on said developer bearing member.

12. The image forming apparatus according to claim 11, wherein the carrier comprises conductive particles.

13. The image forming apparatus according to claim 12, wherein the conductive particles comprise particulate carbon.

14. An image forming method using a two-component developer, comprising the steps of:

forming a latent image on an image bearing member;

bearing a developer comprising a toner and a carrier on a toner bearing member;

applying a vibrating electric field between said image bearing member and a developer bearing member;

developing the latent image with the toner by a non-contacting method;

wherein the following relation holds:

$$10\times10^{-4}<t_1^2/L_T<1.0\times10^{-3}\ (\mathrm{sec}^2/\mathrm{m}),$$

where $t_1$ represents a phase period during which a toner particle of the toner is transferred from the toner bearing member to the latent image during application of the vibrating electric field, and $L_T$ represents a weight average particle diameter of the toner particles.

* * * * *

UNITED STATES PATENT AND TRADEMARK OFFICE

CERTIFICATE OF CORRECTION

PATENT NO. : 5,999,762
DATED : December 7, 1999
INVENTOR(S) : Hisashi Shoji

It is certified that error appears in the above-identified patent and that said Letters Patent is hereby corrected as shown below:

Title page,
Item [30], the 2nd Priority Data has been omitted. It should read as follows:

-- [30] Foreign Application Priority Data

Jul. 4, 1997 [JP] Japan.....9-180130
May 15, 1998 [JP] Japan.....10-133639 --

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*